US008648521B2

(12) United States Patent
Shibuya et al.

(10) Patent No.: US 8,648,521 B2
(45) Date of Patent: Feb. 11, 2014

(54) FLUORESCENT DISPLAY DEVICE HAVING AN OUTER LIGHT SOURCE AND LIGHT SHIELDING FILM

(75) Inventors: Yoshikazu Shibuya, Mobara (JP); Yoshiaki Washio, Mobara (JP); Junichi Ogiwara, Kariya (JP)

(73) Assignee: Futaba Corporation (JP)

( * ) Notice: Subject to any disclaimer, the term of this patent is extended or adjusted under 35 U.S.C. 154(b) by 0 days.

(21) Appl. No.: 13/286,330

(22) Filed: Nov. 1, 2011

(65) Prior Publication Data

US 2012/0104932 A1 May 3, 2012

(30) Foreign Application Priority Data

Nov. 3, 2010 (JP) ..... 2010-246930

(51) Int. Cl.
*H01J 1/62* (2006.01)
*H01J 1/00* (2006.01)

(52) U.S. Cl.
USPC ..... 313/489; 313/496; 313/516

(58) Field of Classification Search
USPC ..... 313/489, 496, 516
See application file for complete search history.

(56) References Cited

U.S. PATENT DOCUMENTS 4,882,659 A * 11/1989 Gloudemans ..... 362/511
5,465,027 A * 11/1995 Ishizuka et al. ..... 313/517
7,521,864 B2 * 4/2009 Ishige et al. ..... 313/553
2005/0269938 A1 * 12/2005 Toki et al. ..... 313/496
2007/0182313 A1 8/2007 Nakamura et al.
2009/0085466 A1 * 4/2009 Kato et al. ..... 313/503
2010/0079056 A1 * 4/2010 Otsuka et al. ..... 313/485

FOREIGN PATENT DOCUMENTS

JP 2002025480 * 1/2002
KR 2001068428 A * 7/2001

OTHER PUBLICATIONS

Chinese Patent Office, First Office Action, Patent Application No. 2011103411562, Aug. 30, 2013, 6 pages.

* cited by examiner

*Primary Examiner* — Nimeshkumar Patel
*Assistant Examiner* — Jacob R Stern
(74) *Attorney, Agent, or Firm* — Quarles & Brady LLP

(57) ABSTRACT

A fluorescent display device is disclosed. The fluorescent display device includes an anode plate, aluminum anode wirings arranged on the anode plate, a first light shielding aluminum film arranged on the anode plate, an insulation layer arranged on both the anode wiring and the first light shielding film, a second light shielding graphite film arranged on the insulation layer, an anode electrode arranged on the insulation layer, and an outer light source display formed by removing a portion of the first light shielding film. The outer light source display is illuminated by a LED to display a predetermined pattern. The second light shielding film is formed along a wiring array arranged on the first light shielding film and the wiring so that a gap between the first light shielding film and the wirings is covered with the second light shielding film.

6 Claims, 5 Drawing Sheets

FLUORESCENT DISPLAY DEVICE HAVING AN OUTER LIGHT SOURCE AND LIGHT SHIELDING FILM

CROSS REFERENCE TO RELATED APPLICATION

This application claims priority benefit of Japan Patent Application No. 2010-246930 and the full content of that application is incorporated by reference.

TECHNICAL FIELD

The present invention relates to a fluorescent display device having a second or an outer light source display for displaying a predetermined pattern by an outer light source arranged on the outer of an envelope of a fluorescent display tube.

BACKGROUND OF THE INVENTION

A fluorescent display device in which a second display is arranged on a light permeable substrate of an envelope of a conventional fluorescent display tube to display a predetermined pattern by illuminating the second display with an outer light source is proposed in Japanese Patent Publication S55-102162.

The fluorescent display device having the conventional second display will be explained with reference to FIG. 5. In the drawings, FIG. 5A is a cross-sectional view of the fluorescent display, and FIG. 5B is a plane view showing a display area of the fluorescent display in which a front plate is omitted. As shown in FIG. 5A, the fluorescent display has an envelope having a glass or anode substrate 81 on which an anode A including a wiring 91 such as an anode wiring, and an insulation layer or film 84, a glass front plate 82 and side plates 83 are arranged. The anode A includes a phosphor film or layer 93 and an anode electrode 92. The phosphor film 93 is deposited on the anode electrode 92. The anode electrode 92 is connected to the anode wiring 91 with a conductor via a through hole of the insulation layer 84. The phosphor film 93 emits light by an electron generated by a filamentous electron source F.

In the insulation layer 84, a second or outer light source display 841 forming a pattern such as characters or symbols is arranged by removing a part of the insulation layer. In the outer surface of the envelope, a lump LP illuminating the second display 841 is arranged. The fluorescent display device shown in FIG. 5A is observed from the arrow X0. The display area of the fluorescent display device in FIG. 5A, as shown in FIG. 5B, includes first fluorescent displays Dp1 and Dp2 displaying a predetermined pattern by the anode A and a second outer light source display Dp3 displaying a predetermined pattern by light of the lump LP.

On the outer light source display 841 of the conventional fluorescent display, a pattern such as characters or symbols is formed by removing the insulation layer 84. The insulation layer 84 is made primarily from glass and pigment. As a result, a light of the lump LP penetrates through a remaining portion or un-removed portion of the outer light source display 841, and the insulation layer 84 around the outer light source display 841. Even through a black insulation layer adding black pigment to the insulation layer is used, light shielding function is not enough. For this reason, the conventional fluorescent display device can not clearly display the character or symbol pattern of the outer light source display 841. Particularly, a high light shielding function is required in the fluorescent display device for use in a vehicle, because the leaked light from the insulation layer stands out at night or a dark place. Accordingly, an object of the present invention is to provide a fluorescent display device eliminating the conventional problems of the fluorescent display device having the outer light source display.

SUMMARY OF THE INVENTION

In order to attain the above object, the present invention provides a fluorescent display device which includes an anode electrode covered with a phosphor film emitting light by an impingement of electrons emitted from an electron source. The anode electrodes are arranged in the envelope having a light permeable anode plate and a front plate opposed to the anode plate. The fluorescence display device further includes a metal wiring arranged on an inner surface of the anode plate, a first light shielding metal film arranged on the inner surface of the anode plate, an insulation layer arranged on both the wiring and the first light shielding film, a metal or graphite second light shielding film arranged on the insulation layer, a metal or graphite anode electrode arranged on the insulation layer, and an outer light source display formed by removing a position of the metal first light shielding film. The second light shielding film is arranged so that a gap between the first light shielding film and the wiring arranged on the first light shielding film is covered with the second light shielding film. A part of the second light shielding film is the anode electrode. The second light shielding film and the anode electrode may be made of graphite, and the metal first light shielding film and the metal wiring may be made of aluminum. In the present invention, a LED is preferably used for a light source of the outer light source display.

According to the fluorescent display device of the present invention, the first light shielding film made of metal such as aluminum having high light-shielding effect is arranged on a place where the second display or outer light source display is formed, and the second display or outer light source display is formed by removing a part of the first light shielding film with a predetermined pattern. Therefore, the display of the second display is clear. Furthermore, the second light shielding film arranged on the fluorescent display device shields the light from the gap between the first light shielding film and the anode electrode. Therefore, damage due to the light leaking from the gap is prevented, and visibility of the display can be maintained. Accordingly, the fluorescent display device of the present invention can be displayed with a high quality even though the second display is formed, and clear display can be effected by the use of a LED as the second display light source.

The fluorescent display device of the present invention includes the metal or graphite second light shielding film and the metal or graphite anode electrode, and the wiring and the anode electrode can be arranged in an area covered by the first light shielding film made of metal such as aluminum. Therefore, the arrangement of the wiring and the position of the anode electrode can be determined easily and freely, which permits complex patterns of the second display to form easily. In addition, the fluorescent display device of the present invention can use the metal or graphite anode electrode as the second light shielding metal or graphite film. Therefore, formation space of the second light shielding film for light-shielding can be reduced. Furthermore, both the wiring and the first light shielding film forming the second display are made of aluminum at the same time. In the same manner, both the anode electrode and the second light shielding film are made of graphite at the same time. Thus, the fluorescent display device of the present invention can reduce number of processes of forming the wiring, the anode electrode, the first light shielding film and the second light shielding film, and those formations can become simple.

DESCRIPTION OF THE PREFERRED EMBODIMENTS

Figure 1A:
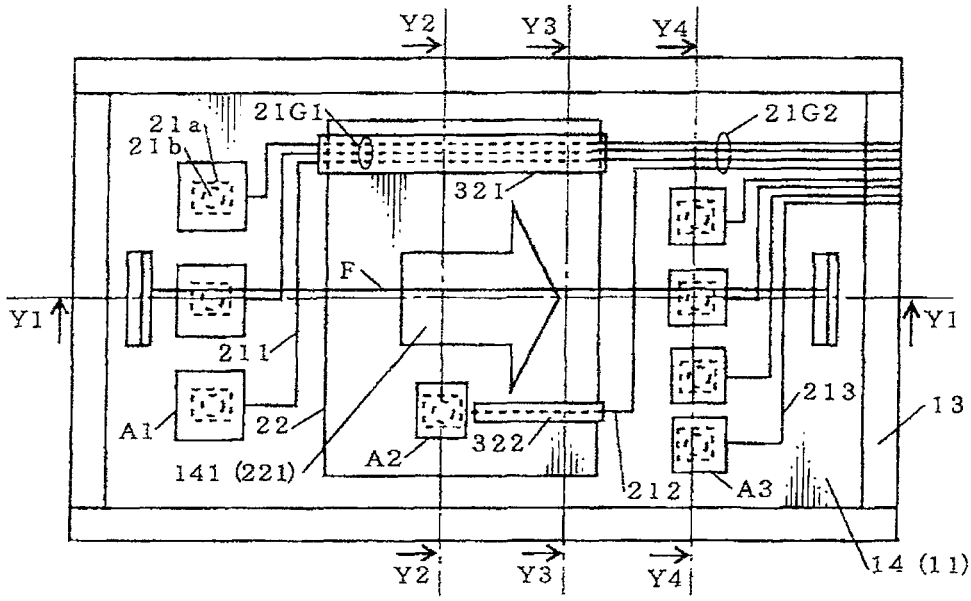
FIG. 1A is a plan view of a fluorescent display device according to an embodiment of the present invention.

A fluorescent display device according to an embodiment of the present invention will be explained with reference to FIGS. 1-4. In the drawings, the same reference numeral designates the same or corresponding portion of the fluorescent display device throughout the serial view.

Figure 1B:
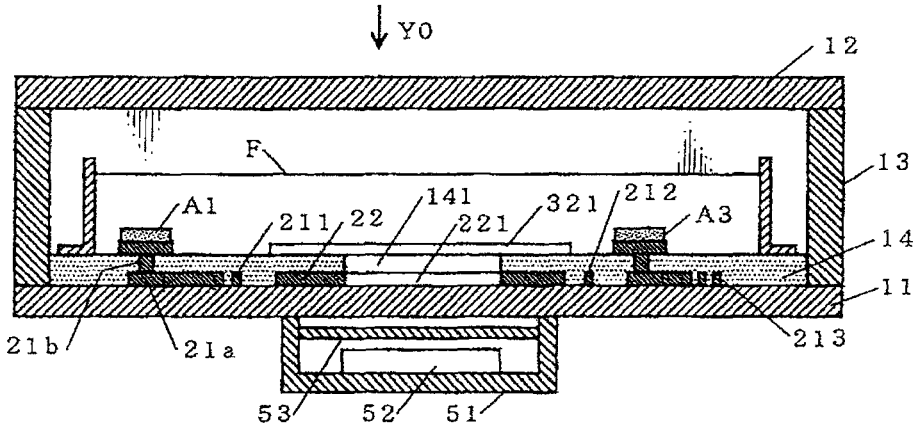
FIGS. 1B and 1C are a cross-sectional view of a fluorescent display device according to an embodiment of the present invention, respectively.
Figure 1C:
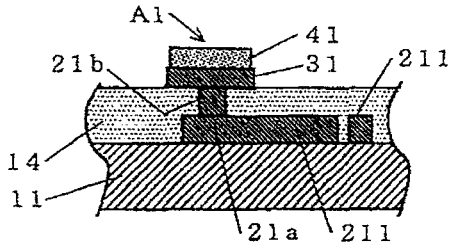
Figure 2A:
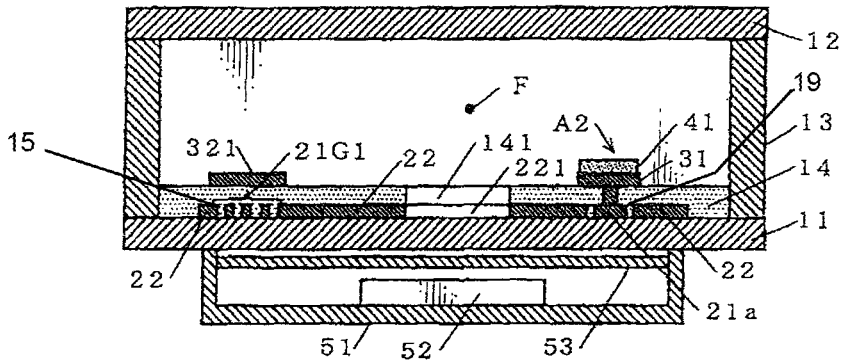
FIGS. 2A-2C are cross-sectional views of the fluorescent display device in FIG. 1, respectively.
Figure 2B:
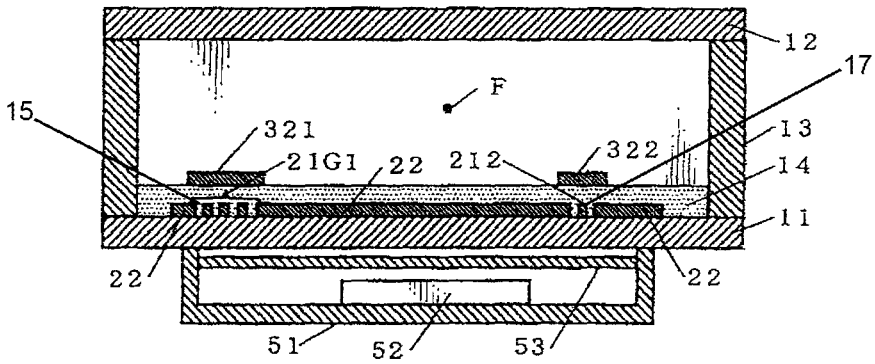
Figure 2C:
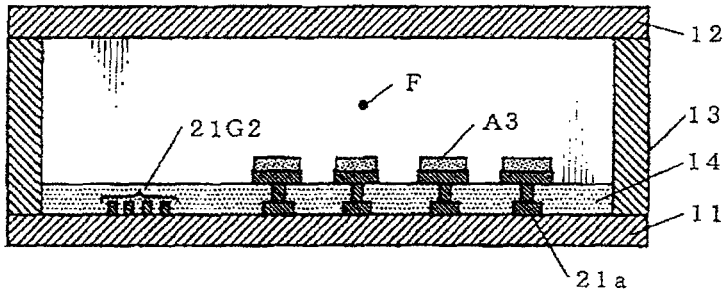

First, the fluorescent display device in FIGS. 1A-1C and 2A-2C will be explained. FIG. 1A is a plan view of a fluorescent display device, FIG. 1B is a cross-sectional view taken along the line Y1-Y1, and FIG. 1C is an enlarged view of an anode A1. FIG. 2A is a cross-sectional view taken along the line Y2-Y2, FIG. 2B is a cross-sectional view taken along the line Y3-Y3, and FIG. 2C is a cross-sectional view taken along the line Y4-Y4 of FIG. 4A. FIG. 1A omits a front plate 12, and shows a portion covered with an insulation layer 14 in a solid line. Also, an anode A is omitted in FIGS. 2A and 2B, and a filament support is omitted in FIGS. 2A, 2B and 2C.

The fluorescent display device of FIG. 1 is a fluorescent display device which is observed from the arrow Y0 shown in FIG. 1B. As shown in FIG. 1A, a display section of the fluorescent display device comprises a first fluorescent display portion for displaying a predetermined pattern by the anodes A1-A3, and a second outer light source display for displaying a predetermined pattern, for example, an arrow mark in FIG. 1 by a LED 52.

As shown in FIGS. 1A and 1B, the fluorescent display device has an envelope which includes a glass substrate anode plate 11 having the anodes A1-A3 arranged thereon, a front plate opposed to the anode plate 11 and side plates 13 made of glass, which are bonded together with low-melting-point glass. On the anode plate 11, aluminum anode wirings 211, 212, and 213 and a first aluminum light shielding film 22 are arranged. On the anode wirings 211, 212, and 213, and the first light shielding films 22, the insulation layer 14 or film is arranged. Further, on the insulation layer 14, the anodes A1-A3 and a second graphite light shielding films 321 and 322 are arranged. On the insulation layer 14, an opening 141 for viewing a second display 221 is formed. As shown in FIG. 1C, the anode A1 includes a graphite anode electrode 31 and a phosphor film or layer 41 deposited on the anode electrode 31. The anode electrode 31 is connected to a wider end 21*a* of the anode wiring 211 via a connected conductor 21*b* arranged into a through hole of the insulation layer 14. The anodes A2 and A3 are constructed in the same manner as the anode A1 explained hereinabove. The phosphor films 41 of the anodes A1-A3 emit light by impingement of electron generated by a filamentous electron source F stretched between two filament supports.

On the first light shielding film 22, the second outer light source display 221 having a pattern such as characters or symbols is formed by removing by a part of the first shielding film 22. On the outer side of the envelope, an outer light source box 51, for example, made of light-shielding material, is arranged. A LED 52 for illuminating the second display 221 and a light diffuser panel 53 are arranged to the inside of the outer light source box 51. The outer light source box 51 is formed in a size smaller than the first light shielding film 22 and larger than the second display 221 so as to cover the second display 221. On the insulation layer 14, a second light shielding film 321 is arranged along a wiring array 21G1 of the anode wirings 211 so that a gap 15 between the first light shielding film 22 and the anode wirings 211 and 212 is covered with the second light shielding film 321. Similarly, the second light shielding film 322 is arranged on the insulation layer 14 along the anode wiring 212 so that a gap 17 between the first light shielding film 22 and the anode wiring 212 is covered with the second light shielding film 322. As a result, the light leaking through the gaps 15, 17 is prevented. Although, the explanation was made with regard to the anode wiring, the wiring may be any wirings other than the anode wiring. Further, the electron source is not limited to the filament, and it may be a field emission type electron source.

Next, the fluorescent display device in FIGS. 2A-2C will be explained. In the fluorescent display device shown in FIG. 2A, the first light shielding film 22, each anode wiring 211 of the wiring array 21G1, and the anode wiring end 21*a* of the anode A2 arranged on the anode plate 11 are made of aluminum. Thus, it is required to electrically insulate the first light shielding film 22, each anode wiring 211 and the anode wiring end 21*a*. For example, in the wiring array 21G1, the first light shielding film 22 and each anode wiring 21 are insulated by the provision of gap 15 between the first light shielding film 22 and each anode wiring 21. However, the light of the LED 52 leaks through the gap 15. In order to prevent the leakage of the light, the second light shielding film 321 is formed along the wiring array 21G1 so that the gap 15 is covered with the second light shielding film 321. Furthermore, in the anode A2, the gap 19 provided between the anode wiring end 21*a* and the first light shielding film 22 is covered with the anode electrode 31 made of the graphite film of the anode A2. Thus, the leakage of the light in the gap 19 can be prevented by the graphite anode electrode 31. Thus, in the embodiment, the graphite film of the anode electrode 31 functions as the second light shielding film.

In FIG. 2B, the wiring array 21G1 is the same as explained in the previous embodiment with reference to FIG. 2A. It should be noted that the anode wiring 212 of the anode A2 is provided with the second light shielding film 322 along the anode wiring 212 so that the gap 17 between the anode wiring 212 and the first light shielding film 22 is covered with the second light shielding film 322. In FIG. 2C, each anode wirings 211 and 212 of the wiring group 21G2 and the anode wiring end 21*a* are arranged outside of the area covered by the first light shielding film 22. Therefore, it is enough to electrically insulate the anode wirings 211 and 212 and the anode wiring end 21*a* with the insulation layer 14. The outside of the area covered by the first light shielding film 22 is not illuminated by the LED 52, thus, there is no problem such as the leakage of the light.

Figure 3A:
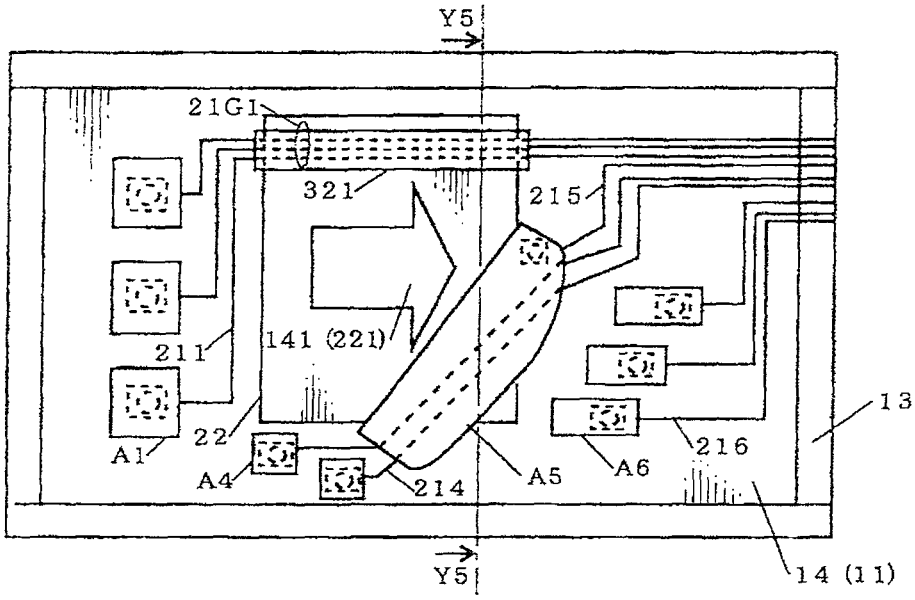
FIG. 3A is a plane view of the fluorescent display device in which a shape of an anode and an arrangement thereof differ in FIG. 1.
Figure 3B:
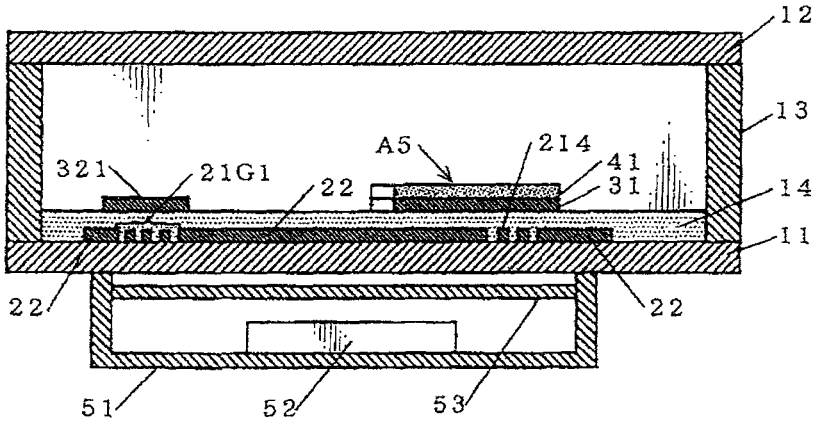
FIG. 3B is a cross-sectional view of the fluorescent display device according to another embodiment of the present invention in which the shape and arrangement of an anode is different from the fluorescent display device of FIG. 1.

Next, the fluorescent display device in FIGS. 3A and 3B will be explained. FIG. 3A is a plan view of the fluorescent display device, and FIG. 3B is a cross-sectional view taken along the line Y5-Y5. In FIG. 3B, an anode A6 is omitted. The fluorescent display device of FIGS. 3A and 3B is an embodiment in which the graphite anode electrode arranged in an area covered by the aluminum first light shielding film functions as the graphite light shielding film as well. When an anode A5 is arranged in the area covered by the first light shielding film 22, an anode wiring 214 of an anode A4 is located in the area covered with the anode electrode 31 of the anode A5. The graphite anode electrode 31 functions as the second light shielding film of the anode wiring 214 arranged in the area covered the first light shielding film 22. Thus, it is not required to arrange the graphite second light shielding film for the anode wiring 214. Furthermore, it is not required to arrange the graphite second light shielding film, because the anode wiring 215 of the anode electrode A5 and an anode wiring 216 of an anode A6 are arranged outside of the area covered by the first light shielding film 22.

Figure 4A:
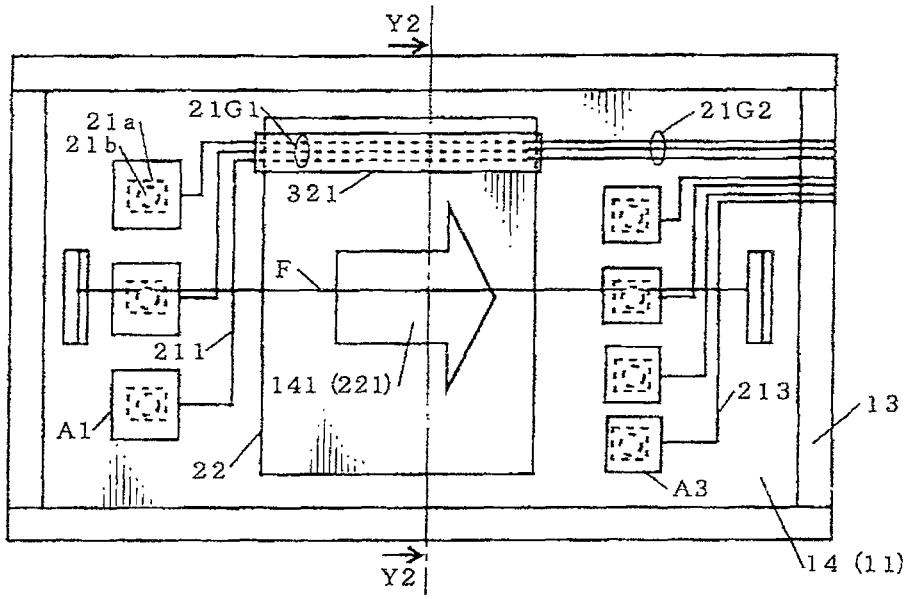
FIG. 4A is a plane view of the fluorescent display device according to another embodiment of the present invention in which the attachment position of an outer light source is different from the fluorescent display device of FIGS. 1, 2, and 3.
Figure 4B:
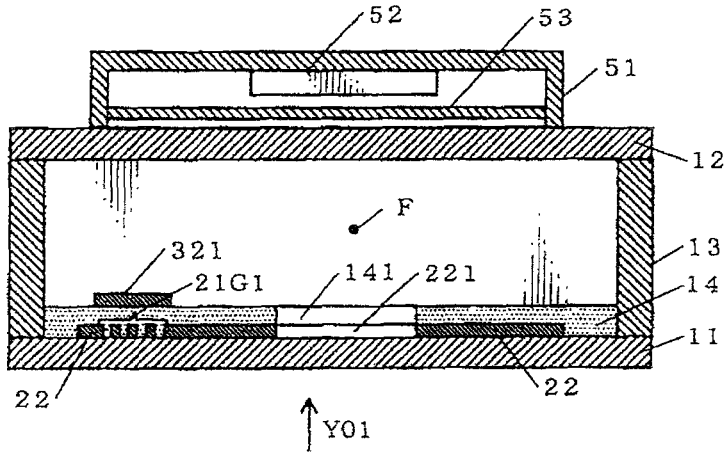
FIG. 4B is a cross-sectional view of the fluorescent display device shown in FIG. 4A.
Figure 5A:
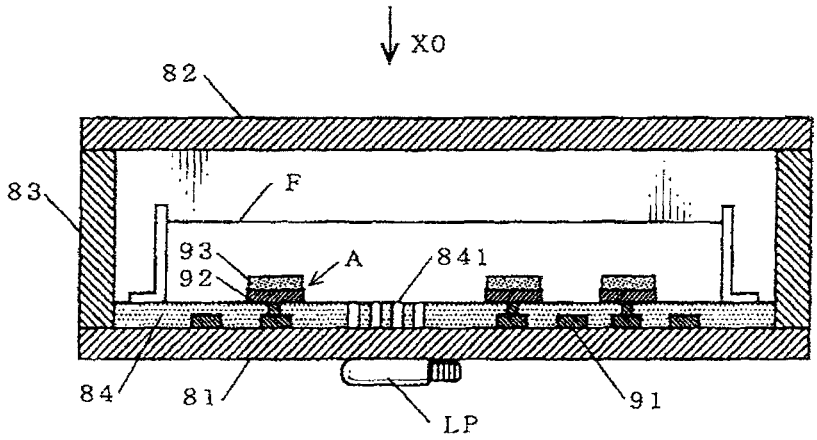
FIG. 5A PRIOR ART
FIG. 5A is a cross-sectional view of a conventional fluorescent display.
Figure 5B:
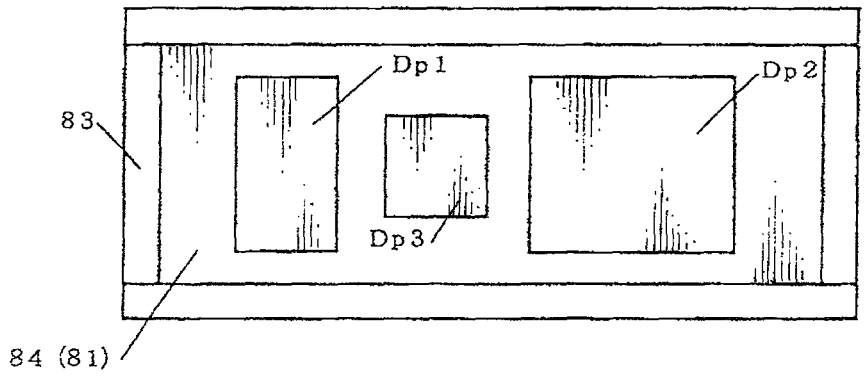
FIG. 5B PRIOR ART
FIG. 5B is a plane view of the conventional fluorescent display device shown in FIG. 5A.

Next, the fluorescent display device in FIGS. 4A and 4B will be explained. The fluorescent display device of FIGS. 4A and 4B is an example of a transparent type fluorescent display device which is observed from the Y01 direction, namely the anode plate 11. The fluorescent display device of FIG. 4A corresponds to the fluorescent display device of FIG. 1A in which the anode A2, the second light shielding film 322 and the anode wiring 212 are not arranged. FIG. 4B is a cross-sectional view taken along the line Y2-Y2 of FIG. 4A. The fluorescent display device of FIGS. 4A and 4B is provided the front plate 12 with the outer light source box 51 installing the LED 52 and the light diffuser panel 53. In the area covered by the first light shielding film 22, the wiring array 21G1 of the anode wiring 211 is arranged, and the anode is not arranged. The anode electrodes 31 of the anodes A1 and A3 is a light permeable electrode formed by a slit of a graphite film. The insulation layer 14 is made of glass containing no pigment. The fluorescent display device of FIG. 4 is observed from the Y01 direction through the anode plate 11. Further, the display of the second display illuminated by the LED 52 can be observed in the same manner as the fluorescent display device of FIGS. 1A to 3B, and the display of the anodes A1, A3 can be viewed through the anode plate 11. In addition, since the gap 15 between the wiring array 21G1 of the anode wirings 211 and the first light shielding film 22 is covered with the second light shielding film 321, the light leaking through the gap 15 can be prevented by the second light shielding film 321.

In the embodiments of the fluorescent display device shown in FIGS. 1A to 4B, the second display 211 formed by removing the aluminum first light shielding film 22 in a predetermined pattern such as characters or symbols is explained. It is to be understood that a sheet or card drawing the desired characters or shapes may be arranged between the light diffuser panel 53 of the outer light source box 51 and the anode plate 11 or the front plate 12, so that the sheet or card can be observed from the second display 221. In this case, it is possible to change the display contents of the second display 221 by replacing the sheet or card. Furthermore, the outer light source box 51 and the LED 52 can be replaced with another display device such as a fluorescent display tube or an organic light emitting display device. In the present invention, outer light source includes a luminescent source, the fluorescent display tube, the organic light emitting display and the like.

According to the fluorescent display device of the present invention explained in FIGS. 1-4, the first shielding light film 22 made of aluminum having high light-shielding effect is used, and the second display 221 is formed by removing the first shielding light film 22 with a predetermined pattern. Therefore, the area other than the second display 221 is not illuminated with the LED 52. That is, light does not leak from the second display 221. Further, when the anode wiring is located in the area covered by the first light shielding film 22, the second light shielding film made of graphite having high light-shielding effect is arranged along the anode wiring so that the gap between the first light shielding film 22 and the anode wiring is covered with the second light shielding film, and light leaking from the gap can be prevented. Accordingly, the fluorescent display device of the present invention can clearly display the pattern of the second display 221 with a high display quality. If the outer light source is the LED, the display of the second display is clear because the LED has high luminosity. On the other hand, possibility of light leaking from the gap between the first light shielding film 22 and the anode wiring is increased. However, according to the fluorescent display device of the present invention, the light can be prevented from leaking by the provision of the graphite second light shielding film. Thus, the fluorescent display device of the present invention can permit LED to use as the outer light source of the second display, and effect clear display.

In a fluorescent display device, a lot of wirings and electrodes have to arrange on very small space. However, the fluorescent display device of the present invention can arrange a lot of wirings and electrodes in the area covered by the aluminum first light shielding film, because of the arrangement of the graphite second light shielding film and the graphite anode electrode, which makes it possible to arrange the wiring and electrode in the limited space easily and freely, and to display complex patterns. In addition, the graphite anode electrode arranged on the aluminum first light shielding film can be used as the graphite second light shielding film. Therefore, the space so as to arrange the graphite film for use in light-shielding can be reduced. Furthermore, both the anode wiring and the first light shielding film for the second display are made of aluminum, and both the anode electrode and the second light shielding film are made of graphite. Therefore, the anode wiring and the first light shielding film can be formed together, and the anode electrode and the second light shielding film can be formed together. Thus, the fluorescent display device of the present invention can reduce number of processes of forming the anode wiring, the anode electrode, the first light shielding film and the second light shielding film, and those formations can become simple.

According to the fluorescent display device of the present invention, the first light shielding film for arranging the anode wiring and the second display are made of aluminum including aluminum alloy. However, it is not limited to aluminum. The first light shielding film may be made of various metals such as copper including copper alloy. In that case, since the anode wiring and the first light shielding film are formed with the same metal, processes for forming both the anode wiring and the first light shielding film can be reduced. The anode electrode arranged on the insulation layer and the second light shielding film arranged on the insulation layer are made of graphite. However, it is not limited to graphite. The anode electrode and the second light shielding film may be made of various metals such as copper including copper alloy not limited to graphite. In that case, since the anode electrode and the second light shielding film are formed with the same metal, processes for forming both the anode electrode and the second light shielding film can be reduced. The side plate is formed of a separate plate. However, the side plate may be a part of the cover plate forming the front plate and the side plate together. The fluorescent display device of the present invention is constructed with a diode having the electron source and the anode. However, the fluorescent display device may be constructed with a triode having the electron source, the anode and a control electrode such as a grid arranged between the electron source and the anode.

The foregoing description was primarily directed to a preferred embodiment of the present invention. Although some description was given to various alternations within the scope of the invention, it is anticipated that one skilled in the art likely realizes additional alternations that are now apparent from disclosure of embodiments of the invention. It is therefore to be understood that within the scope of the appended claims, the invention may be practiced otherwise than as specifically described.

What is claimed is:

1. A fluorescent display device, comprising:

an envelope having a light permeable anode plate and a front plate opposite to the anode plate;

an electron source arranged in the envelope;

a wiring arranged on an inner surface of the anode plate;

a first light shielding metal film arranged on a portion of the inner surface of the anode plate;

a gap created between a portion of the first light shielding metal film and a portion of the wiring disposed within the portion of the anode plate that includes the first light shielding metal film;

an insulation layer arranged on both the wiring and the first light shielding film;

a second light shielding film arranged on the insulation layer;

an anode electrode covered with a phosphor film emitting light by an impingement of electrodes emitted from the electron source, the anode electrode arranged on the insulation layer; and an outer light source display formed by removing a portion of the first light shielding metal film, wherein the second light shielding film is positioned over the gap between the first light shielding film and the wiring arranged on the inner surface of the anode plate to cover the gap with the second light shielding film and prevent light leaking through the gap.

2. The fluorescent display device as claimed in claim 1, wherein a part of the second light shielding film is the anode electrode.

3. The fluorescent display device as claimed in claim 1, wherein the second light shielding film and the anode electrode are made of graphite.

4. The fluorescent display device as claimed in claim 1, wherein the second light shielding film and the anode electrode are made of metal.

5. The fluorescent display device as claimed in claim 4, wherein the metal first light shielding film and the wiring are made of aluminum.

6. The fluorescent display device as claimed in claim 1, wherein the light source of the outer light source display is a LED.

* * * * *